US010283250B2

(12) United States Patent
Guo et al.

(10) Patent No.: US 10,283,250 B2
(45) Date of Patent: May 7, 2019

(54) METHOD FOR MANUFACTURING HIGH-DENSITY INTEGRALLY-MOLDED INDUCTOR

(71) Applicant: POCO Holding Co., Ltd., Shenzhen (CN)

(72) Inventors: Xiongzhi Guo, Shenzhen (CN); Qiang Xiao, Shenzhen (CN); Jialin Ruan, Shenzhen (CN); Jun Qiu, Shenzhen (CN); Zhida Liu, Shenzhen (CN); Tao Luo, Shenzhen (CN); Yunfan Zhang, Shenzhen (CN)

(73) Assignee: POCO Holding Co., LTd., Shenzhen (CN)

( * ) Notice: Subject to any disclaimer, the term of this patent is extended or adjusted under 35 U.S.C. 154(b) by 0 days.

(21) Appl. No.: 15/525,285

(22) PCT Filed: Jun. 4, 2015

(86) PCT No.: PCT/CN2015/080827
§ 371 (c)(1),
(2) Date: May 8, 2017

(87) PCT Pub. No.: WO2016/192095
PCT Pub. Date: Dec. 8, 2016

(65) Prior Publication Data

US 2017/0345540 A1 Nov. 30, 2017

(51) Int. Cl.

| | |
|---|---|
| ***H01F 7/06*** | (2006.01) |
| ***H01F 17/04*** | (2006.01) |
| ***H01F 41/076*** | (2016.01) |
| ***H01F 41/04*** | (2006.01) |
| ***H01F 27/02*** | (2006.01) |
| ***H01F 27/255*** | (2006.01) |
| ***H01F 41/00*** | (2006.01) |
| ***H01F 41/02*** | (2006.01) |
| ***H01F 1/147*** | (2006.01) |
| ***H01F 1/26*** | (2006.01) |
| *H01F 1/057* | (2006.01) |
| *H01F 7/02* | (2006.01) |

(52) U.S. Cl.
CPC ..... *H01F 17/04* (2013.01); *H01F 1/14758* (2013.01); *H01F 1/14791* (2013.01); *H01F 1/26* (2013.01); *H01F 27/022* (2013.01); *H01F 27/255* (2013.01); *H01F 41/005* (2013.01); *H01F 41/0246* (2013.01); *H01F 41/046* (2013.01); *H01F 41/076* (2016.01); *H01F 1/0576* (2013.01); *H01F 7/0221* (2013.01)

(58) Field of Classification Search
CPC .... H01F 17/0013; H01F 17/04; H01F 27/292; H01F 41/04; H01F 5/00; H01F 3/08
See application file for complete search history.

(56) References Cited

U.S. PATENT DOCUMENTS

| | | | | |
|---|---|---|---|---|
| 6,373,368 | B1 * | 4/2002 | Shikama | H01F 41/04 29/605 |
| 9,847,156 | B2 * | 12/2017 | Inaba | H01F 1/01 |
| 2002/0180038 | A1 * | 12/2002 | Oshima | H01F 27/027 257/729 |
| 2009/0053513 | A1 * | 2/2009 | Enzinger | B29C 55/023 428/339 |
| 2010/0055416 | A1 * | 3/2010 | Yang | H01B 1/24 428/195.1 |
| 2010/0283568 | A1 | 11/2010 | Zapf | |
| 2014/0368305 | A1 * | 12/2014 | Chao | H01F 17/04 336/90 |
| 2016/0005031 | A1 * | 1/2016 | O'Regan | G06F 21/86 705/65 |

FOREIGN PATENT DOCUMENTS

| | | | |
|---|---|---|---|
| CN | 101552091 | A | 10/2009 |
| CN | 103151131 | A | 6/2013 |
| CN | 104200981 | A | 12/2014 |

OTHER PUBLICATIONS

International Search Report for PCT/CN2015/080827.
International Publication for PCT/CN2015/080827.

* cited by examiner

*Primary Examiner* — Paul D Kim

(57) ABSTRACT

Provided is a method for manufacturing a high-density integrally-molded inductor, comprising the following steps: (1) winding an enameled wire coil to be spiral; (2) mechanically pressing first ferromagnetic powder into a magnetic core; (3) mounting the magnetic core into a hollow cavity of the enameled wire coil; (4) mounting the enameled wire coil provided with the magnetic core into an injection mold; (5) uniformly mixing and stirring resin glue, a coupling agent and an accelerant, to obtain high-temperature resin glue; (6) uniformly stirring second ferromagnetic powder and the high-temperature resin glue, to obtain a magnetic composite material; (7) injecting the magnetic composite material into a mold cavity of the injection mold for molding, and solidifying the magnetic composite material to obtain an outer magnet; and (8) cooling and de-molding the outer magnet, to obtain a molded inductor.

8 Claims, No Drawings

METHOD FOR MANUFACTURING HIGH-DENSITY INTEGRALLY-MOLDED INDUCTOR

BACKGROUND

1. Technical Field

The present disclosure generally relates to inductor component technology field, and especially relates to a method for manufacturing a high-density integrally-molded inductor.

2. Description of Related Art

With the development of electronic industry, filters, chokes, transformers and reactors are widely used in electronic control systems being configured within powers, such as switch power, Uninterruptible Power Supply (UPS), photovoltaic inverter and wind energy. The inductor-related components may adopt filtration, rectification and inversion.

For the development of modern electronic industry, the inductors or reactors have played an important role. The components manufactured by the traditional method cannot be applicable to the future development of miniaturization. It is of great significance to develop high-performance, compact inductors or reactors, which may contribute to the rapid development of modern electronic technology.

The manufacturing process of the conventional inductors or reactors includes:

1. Ring-type magnetic core may be formed by artificial threading or machine-assisting threading. Such inductor has complex manufacturing process and high cost of production, and requires high consistency of the magnetic rings. Most of the inductors need to be wound manually or semi-automatically to form the insulating coil on the surface of the magnetic coil. Therefore, it is hard to realize the automatic production. For the mass production in the factory, more manpower and time are needed, which increases the cost of the production such that the development of the inductor and the progress of the modern electronic information technology have been limited greatly. In addition, 1) reliability with respect to the electrode pads is insufficient. The pin of the conventional wire-wound power inductor is basically lead out by the enameled wire and is linked to the sheet-shaped or circular-shaped electrodes glued with epoxy resin. It is then soldered to form reliable and good contact. Therefore, because the material expansion coefficient and the contraction coefficient are different, the heating and cooling, process in the inductor operation result in different expansion and different contraction, such that the pad may fall off resulting abnormal quality risk after being used for a long period of time. 2) During operations, the body of the inductor may be heated up due to the electric current, the pin of the enameled wire and the soldering pad of the inductor may oxide after operating under long-period and high-temperature condition, which results in abnormal opening of the inductor.

2. Conventional SMD wound power inductor. Most of the soldered pads use organic adhesive, mainly including epoxy resin, to bond the magnetic core body. Due to the assembling tolerance of the inductor, the coplanar is poor between the inductor and the PCM when being mounted. The reliability of the pad may not be enough after being used after a long-period of time 3. Skeleton-type ferrite may be wound via machine-assisted and automation manner. Due to the heat of the inductor resulting from leakage flux, it is necessary to increase the diameter of the coil to improve the heat dissipation such that the temperature may be cooled down. During the inductor operation, the mechanical or electromagnetic resonance noise may be avoided. In other words, as this type of inductor or reactor, requires high reliability, the material cost has to be enhanced so as to meet the requirement. A segment gap can only solve the utilization of the winding space.

4. Rail-shaped ferrite or alloy may be produced automatically. Most conventional power inductors are made by adopting line rail-shaped magnetic core material as the body. The structure results in bottle-neck as below. 1) The anti-falling performance of the inductor is poor. The structure of the rail-shaped inductor causes the anti-falling or crashing attributes regarding edges of the inductor body weak, resulting in that the magnetic coil may break. 2) During the assembling process of the inductor, the body of the power inductor can be easily break due to abnormal installation or shifted position of the material. In addition, the mechanic strength of a great portion of the rail-shaped winding products is increased by installing the magnetic adhesive into the notch of the side surface of the magnetic core so as to reduce the interference of the magnetic loss. The shortcomings include: 1. Structure defects, such as bubbles, may occur during installation of the magnetic adhesive, therefore resulting in that the coil cannot sufficiently contact the magnetic adhesive. As such, the heat dissipation of the coil may be poor, and noise may occur, which not only shorten the lifetime of the inductor, but also results in poor circuit. 2) The expansion or contraction of the magnetic material, during hunting or cooling, is different between the magnetic core and coil, such that the inductor can cause adhesive to fall off during long-period, high-temperature, and high-electric current, resulting or attributes of the magnetic shielding and mechanism characteristics.

5. The conventional wound power inductor is made by open, heat shrink tubing and magnetic adhesive (mainly based on customer scenarios, reliable and stable requirements and selection). The shielding effect toward the magnetic loss is poor, resulting in interference against the IC and the power module, which are sensitive to the electromagnetic field near the inductor. This makes the performance of the products drop and increases the EMI solution cost.

6. The development of the conventional wound power inductor is limited due to the structure and the material of the magnetic core. The volume and the dimension of the inductor products are limited due to the high-constant current, and thus is not suitable for the portable electronic product requiring high-density and the volume and space requirement. Therefore, such solution is hunted when being compared to new stack-up and platform type power inductors.

Chinese Patent Publication No. CN101552091A discloses an inductor of a metal powder injection molding and a processing method of the inductor, which uses a composite material made mainly by metal soft magnetic power and the thermosetting binder to inject. The method, to some extent, solves the problems of high cost of pressing powder and solves the problem regarding complex equipment. But, this method combines thermosetting adhesive and magnetic powder, which results in low inductance and the poor DC bias.

In view of the above, a novel method for producing high-density integrated injection molding inductance is necessary.

SUMMARY

The disclosure relates to a method for manufacturing an inductor to solve the problem of the current inductor that has poor electromagnetic properties, low density, large volume and poor heat dissipation effect. It also solves the problem of the conventional manufacturing method of the integrally-forming inductor, which causes mechanical stress damage to the coil. That is, the inductor of the disclosure does not hurt or damage the insulating ability of the original coil.

To achieve the above object, the disclosure utilizes the technique solution as below:

A method for manufacturing a high-density integrally-molded inductor includes the steps of: (1) winding an enameled wire coil to be spiral; (2) mechanically pressing a first ferromagnetic powder into a magnetic core with a density in a range from 6.2 to 6.9 g/cm3; (3) mounting the magnetic core into a hollow cavity of the enameled wire coil; (4) mounting the enameled wire coil provided with the magnetic core into an injection mold; (5) uniformly miring and stirring resin glue having a concentration in a range from 70 to 80%, a coupling agent having a concentration in a range from 5 to 10%, and an accelerant having a concentration in a range from 15 to 2.0% to obtain a high-temperature resin glue; (6) uniformly stirring a second ferromagnetic powder having a concentration in a range from 88 to 94% and the high-temperature resin glue having a concentration in a range from 6 to 12% to obtain a magnetic composite material; (7) injecting the magnetic composite material into a mold cavity of the injection mold for molding, and solidifying for 1.5 to 25 hours at 125 to 140 degrees Celsius to obtain an outer magnet with a density in a range from 5.5 to 6.2 g/cm3; and (8) cooling and de-molding the outer magnet to obtain a molded inductor.

Furthermore, a size-ratio of the second ferromagnetic powder is: −100 mesh to 200 mesh having a concentration in a range from 20 to 30%, −200 mesh to 500 mesh having a concentration in a range from 30 to 40%, and −500 mesh having a concentration in a range from 30 to 50%.

Furthermore, the first ferromagnetic powder is a ferrosilicon powder.

Furthermore, the second ferromagnetic powder is at least one of a ferrosilicon powder, an iron powder, ferrosilicon aluminum powder, iron nickel powder, and ferrosilicochromium powder.

Furthermore, the resin glue is a modified epoxy silicone resin.

Furthermore, the coupling agent is a 3-Mercyptopropylmethyldimethoxysilane.

Furthermore, the accelerant is an isophthalic diamine.

Furthermore, after the step of (8), the manufacturing method further includes disposing a heat dissipater outside the molded inductor.

Furthermore, the heat dissipater is a pure aluminum material.

Compared with the prior art, the beneficial effects of the disclosure are: the inductor by using the manufacturing method of above solution has advantages as below:

(1) By mounting the magnetic core into the enameled coil, the manufacturing method of the disclosure simplifies the winding technique for the magnetic core of the inductor, and realizes the automatic production.

(2) By utilizing the integrally-molded manufacturing method, it is simpler to manufacture an inductor, therefore reducing the cost of production.

(3) The inductor using the manufacturing method of the disclosure is small in size, high in density, high in relative permeability, better in heat dissipation and long in service life.

(4) The density of the magnetic core is different from the density of the outer magnet, ensuring the maximization of magnetic density of the entire inductor, such that the inductor has excellent electromagnetic properties.

(5) Overall, closed magnetic shielding structure is realized, and the EMI effect of the inductor of the disclosure is better than traditional integrally-formed inductor.

(6) It has low noise by using the integrally-formed inductor.

(7) It has the lowest direct-current resistance among the same size.

(8) It causes no mechanical stress damage to coils. That is, it does not hurt or damage the insulating ability of the coil.

(9) By utilizing the manufacturing method of the disclosure, the outline shape of the inductor can be designed arbitrarily, therefore realizing divergent shapes.

DETAILED DESCRIPTION

A number of embodiments are disclosed below for elaborating the disclosure. However, the embodiments of the disclosure are for detailed descriptions only, not for limiting the scope of protection of the disclosure. It is clear that the described embodiments are merely part of the embodiments of the disclosure, but not all embodiments. Based on the embodiments of the present disclosure, all other embodiments that persons skilled in the art have no creative work are within the scope of the disclosure.

Embodiment 1

A method for manufacturing a high-density integrally-molded inductor includes the steps of:

(1) By a coil winding machine, winding an enameled wire coil to be spiral;

(2) Mechanically pressing a first ferromagnetic powder into a magnetic core with a density of 6.5 g/cm3. The first ferromagnetic powder is a ferrosilicon powder;

(3) Mounting the magnetic core into a hollow cavity of the enameled wire coil;

(4) Mounting the enameled wire coil provided with the magnetic core into an injection mold;

(5) Uniformly mixing and stirring a modified epoxy silicone resin, a 3-Mercaptopropylmethyldimethoxysilane, and an isophthalic diamine to obtain a high-temperature resin glue. The weight ratio of the modified epoxy silicone resin, the 3-Mercaptopropylmethyldimethoxysilane and the isophthalic diamine are respectively 7:1:2;

(6) Uniformly stirring a second ferromagnetic powder and the high-temperature resin glue to obtain a magnetic composite material. The weight ratio of the second ferromagnetic powder and the high-temperature resin adhesive are respectively 94:6, and a size-ratio of the second ferromagnetic powder is: −100 mesh to 200 mesh, −200 mesh to 500 mesh, and −500 mesh to mix up according to the proportion of 2:3:5;

(7) Injecting the magnetic composite material into a mold cavity of the injection mold for molding, and solidifying the magnetic composite material for 2 hours at 130 degrees Celsius to obtain an outer magnet with a density of 6.2 g/cm3;

(8) Cooling and de-molding the outer magnet, to obtain a molded inductor; and (9) Disposing a heat dissipater outside the molded inductor. The heat dissipater a pure aluminum material.

Embodiment 2

A method for manufacturing a high-density integrally-molded inductor includes the steps of:

(1) By a coil winding machine, winding an enameled wire coil to be spiral;

(2) Mechanically pressing a first ferromagnetic powder into a magnetic core with a density of 6.2 g/cm3. The first ferromagnetic powder is a ferrosilicon powder;

(3) Mounting the magnetic core into a hollow cavity of the enameled wire coil;

(4) Mounting the enameled wire coil provided with the magnetic core into an injection mold;

(5) Uniformly mixing and stirring a modified epoxy silicone resin, a 3-Mercaptopropylmethyldimethoxysilane, and an isophthalic diamine to obtain a high-temperature resin glue. The weight ratio of the modified epoxy silicone resin, the 3-Mercaptopropylmethyldimethoxysilane and the isophthalic diamine are respectively: 75:7:18;

(6) Uniformly stirring a second ferromagnetic powder and the high-temperature resin glue to obtain a magnetic composite material. The weight ratio of the second ferromagnetic powder and the high-temperature resin glue are respectively 9:1, and a size-ratio of the second ferromagnetic powder being: −100 mesh to 200 mesh, −200 mesh to 500 mesh, and −500 mesh to mix up according to the proportion: 25:35:40;

(7) Injecting the mimetic composite material into a mold cavity of the injection mold for molding, and solidifying the magnetic composite material for 2.5 hours at 125 degrees Celsius to obtain an outer magnet with a density of 5.9 g/cm3;

(8) Cooling and de-molding the outer magnet to obtain a molded inductor; and (9) Disposing a heat dissipater outside the molded inductor, the heat dissipater being a pure aluminum material.

Embodiment 3

A method for manufacturing a high-density integrally-molded inductor includes the steps of:

(1) By a coil winding machine, winding an enameled wire coil to be spiral;

(2) Mechanically pressing a first ferromagnetic powder into a magnetic core with a density of 6.9 g/cm3. The first ferromagnetic powder is a ferrosilicon powder;

(3) Mounting the magnetic core into a hollow cavity of the enameled wire coil;

(4) Mounting the enameled wire coil provided with the magnetic core into an injection mold;

(5) Uniformly mixing and stirring an epoxy silicone resin, a 3-Mercaptopropylmethyldimethoxysilane, and an isophthalic diamine to obtain a high-temperature resin glue. The weight ratio of epoxy silicone resin, the 3-Mercaptopropylmethyldimethoxysilane, and the isophthalic diamine are respectively 80:5:15;

(6) Uniformly stirring a second ferromagnetic powder and the high-temperature resin glue to obtain a magnetic composite material. The weight ratio of the second ferromagnetic powder and the high-temperature resin glue are respectively 88:12, and a size-ratio of the second ferromagnetic powder being: −100 mesh to 200 mesh, −200 mesh to 500 mesh, and −500 mesh to mix up according to the proportion: 3:4:3;

(7) Injecting the magnetic composite material into a mold cavity of the injection mold for molding, and solidifying the magnetic composite material for 1.5 hours at 140 degrees Celsius to obtain an outer magnet with a density of 5.5 g/cm3;

(8) Cooling and de-molding the outer magnet to obtain a molded inductor; and (9) Disposing a heat dissipater outside the molded inductor. The heat dissipater is a pure aluminum material.

Embodiment 4

A method for manufacturing a high-density integrally-molded inductor includes the steps of:

(1) By a coil winding machine, winding an enameled wire coil to be spiral;

(2) Mechanically pressing a first ferromagnetic powder into a magnetic core with a density of 6.9 g/cm3. The first ferromagnetic powder is a ferrosilicon powder;

(3) Mounting the magnetic core into a hollow cavity of the enameled wire coil;

(4) Mounting the enameled wire coil provided with the magnetic core into an injection mold;

(5) Uniformly mixing and stirring a modified epoxy silicone resin, a 3-Mercaptopropylmethyldimethoxysilane, and an isophthalic diamine to obtain a high-temperature resin glue. The weight ratio of the modified epoxy silicone resin, the 3-Mercaptopropylmethyldimethoxysilane, and the isophthalic diamine are respectively 7:1:2;

(6) Uniformly stirring a second ferromagnetic powder and the high-temperature resin glue to obtain a magnetic composite material. The weight ratio of the second ferromagnetic powder and the high-temperature resin glue are respectively 9:1, and a size-ratio of the second ferromagnetic powder being: −100 mesh to 200 mesh, −200 mesh to 500 mesh, and −500 mesh to mix up according to the proportion: 2:3:5;

(7) Injecting the magnetic composite material into a mold cavity of the injection mold for molding, and solidifying the magnetic composite material for 2 hours at 130 degrees Celsius to obtain an outer magnet with a density of 6.0 g/cm3;

(8) Cooling and de-molding the outer magnet to obtain a molded inductor; and (9) Disposing a heat dissipater outside the molded inductor, the heat dissipater being a pure aluminum material.

The inductors are manufactured to the same condition according the embodiments 1 to 4, and the inductors are tested by the electrical performance comparison test with the traditional inductor. The data are shown as below:

| | The traditional inductor | The embodiment 1 | The embodiment 2 | The embodiment 3 | The embodiment 4 |
|---|---|---|---|---|---|
| Coil number | 30 | 30 | 30 | 30 | 30 |
| The length of effective magnetic circuit 1 (cm) | 15.8 | 15.8 | 15.8 | 15.8 | 15.8 |

-continued

| | The traditional inductor | The embodiment 1 | The embodiment 2 | The embodiment 3 | The embodiment 4 |
|---|---|---|---|---|---|
| Initial inductance L@0A | 201.54 | 269.62 | 268.64 | 269.32 | 269.87 |
| The inductance in the 5A L@5A | 180.26 | 266.69 | 265.51 | 265.84 | 266.95 |

For the skilled in the art, it is clear that the disclosure is not limited to the details of an exemplary embodiment. And without departing from the spirit or essential characteristics of the present disclosure, it is possible to realize the disclosure with other specific forms. Therefore, no matter with any points, it should be seen as an exemplary embodiment, but not limiting, the scope of the present disclosure is defined by the appended claims rather than the foregoing description define, and therefore intended to fall claim All changes which come within the meaning and range of equivalents of the elements to include in the present invention

What is claimed is:

1. A method for manufacturing a high-density integrally-molded inductor, comprising:

(1) winding an enameled wire coil to be spiral;

(2) mechanically pressing a first ferromagnetic powder into a magnetic core with a density in a range from 6.2 to 6.9 g/cm$^3$;

(3) mounting the magnetic core into a hollow cavity of the enameled wire coil;

(4) mounting the enameled wire coil provided with the magnetic core into an injection mold;

(5) uniformly mixing and stirring resin glue having a concentration in a range from 70 to 80%, a coupling agent having a concentration in a range from 5 to 10%, and an accelerant having a concentration in a range from 15 to 20% to obtain a high-temperature resin glue;

(6) uniformly stirring a second ferromagnetic powder having a concentration in a range from 88 to 94% and the high-temperature resin glue having a concentration in a range from 6 to 12% to obtain a magnetic composite material;

(7) injecting the magnetic composite material into a mold cavity of the injection mold for molding, and solidifying the magnetic composite material for 1.5~2.5 hours at 12~140 degrees Celsius to obtain an outer magnet with a density of 5.5~6.2 g/cm$^3$; and (8) cooling and de-molding the outer magnet to obtain the molded inductor.

2. The method for manufacturing the high-density integrally-molded inductor as claimed in claim 1, wherein a size-ratio of the second ferromagnetic powder is: −100 mesh to 200 mesh having a weight ratio in a range from 20 to 30%, −200 mesh to 500 mesh having a weight ratio in a range from 30 to 40%, and −500 mesh having a weight ratio in a range from 30 to 50%.

3. The method for manufacturing the high-density integrally-molded inductor as claimed in claim 1, wherein the first ferromagnetic powder is a ferrosilicon powder.

4. The method for manufacturing the high-density integrally-molded inductor as claimed in claim 1, wherein the second ferromagnetic powder is at least one of a ferrosilicon powder, an iron powder, ferrosilicon aluminum powder, iron nickel powder, and ferrosilicochromium powder.

5. The method for manufacturing the high-density integrally-molded inductor as claimed in claim 1, wherein the resin glue is a modified epoxy silicone resin.

6. The method for manufacturing the high-density integrally-molded inductor as claimed in claim 1, wherein that the coupling agent is a 3-Mercaptopropyl methyl dim ethoxy silane.

7. The method for manufacturing the high-density integrally-molded inductor as claimed in claim 1, wherein the accelerant is an isophthalic diamine.

8. The method for manufacturing the high-density integrally-molded inductor as claimed in claim 1, wherein the magnetic core has a density of 6.5 g/cm$^3$, the first ferromagnetic powder is a ferrosilicon powder, the resin glue is a modified epoxy silicone resin, the coupling agent is a 3-Mercaptopropylmethyldimethoxysilane, and the accelerant is an isophthalic diamine, a weight ratio of the modified epoxy silicone resin, the 3-Mercaptopropylmethyldimethoxysilane and the isophthalic diamine are respectively 7:1:2, a weight ratio of the second ferromagnetic powder and the high-temperature resin glue are respectively 94:6, and a size-ratio of the second ferromagnetic powder is: −100 mesh to 200 mesh, −200 mesh to 500 mesh, and −500 mesh to mix up according to a proportion of 2:3:5, and the magnetic composite material is solidified for 2 hours at 130 degrees Celsius to obtain the outer magnet with a density of 6.2 g/cm$^3$.

* * * * *